US011122358B2

(12) United States Patent
Kuipers

(10) Patent No.: US 11,122,358 B2
(45) Date of Patent: Sep. 14, 2021

(54) HEARING DEVICE COMPRISING A VENT WITH AN ADJUSTABLE ACOUSTIC VALVE

(71) Applicant: Sonova AG, Stafa (CH)

(72) Inventor: Erwin Kuipers, Wolfhausen (CH)

(73) Assignee: SONOVA AG, Stäfa (CH)

( * ) Notice: Subject to any disclaimer, the term of this patent is extended or adjusted under 35 U.S.C. 154(b) by 24 days.

(21) Appl. No.: 16/815,277

(22) Filed: Mar. 11, 2020

(65) Prior Publication Data

US 2020/0314532 A1 Oct. 1, 2020

(30) Foreign Application Priority Data

Mar. 27, 2019 (EP) ..... 19165553

(51) Int. Cl.
*H04R 25/00* (2006.01)
*H04R 1/10* (2006.01)

(52) U.S. Cl.
CPC ..... *H04R 1/1091* (2013.01); *H04R 1/1016* (2013.01); *H04R 2460/11* (2013.01)

(58) Field of Classification Search
CPC ..... H04R 2460/09; H04R 2460/11
See application file for complete search history.

(56) References Cited

U.S. PATENT DOCUMENTS

| | | | | |
|---|---|---|---|---|
| 5,987,146 | A | 11/1999 | Pluvinage et al. | |
| 6,549,635 | B1 | 4/2003 | Gebert | |
| 6,823,176 | B2 | 11/2004 | Rogers | |
| 7,609,842 | B2 | 10/2009 | Sipkema et al. | |
| 9,774,941 | B2 * | 9/2017 | Grinker | H04R 3/04 |
| 10,937,407 | B2 * | 3/2021 | Goldstein | A61B 5/0205 |
| 2011/0311069 | A1 * | 12/2011 | Ambrose | H04R 1/10 381/71.6 |
| 2020/0213731 | A1 * | 7/2020 | Miller | H04R 3/005 |
| 2020/0288251 | A1 * | 9/2020 | Kuipers | H04R 1/2803 |
| 2021/0092536 | A1 * | 3/2021 | Roeck | H04R 25/48 |

FOREIGN PATENT DOCUMENTS

| | | | |
|---|---|---|---|
| DE | 19942707 | A1 | 3/2001 |
| DE | 10 2005 006 404 | B3 | 8/2006 |
| EP | 2 202 996 | A2 | 6/2010 |
| EP | 2 835 987 | B1 | 8/2017 |
| WO | 2010/034337 | A1 | 4/2010 |
| WO | 2019/052715 | A1 | 3/2019 |

* cited by examiner

*Primary Examiner* — Ryan Robinson
(74) *Attorney, Agent, or Firm* — Pearne & Gordon LLP

(57) ABSTRACT

Provided is a hearing device including a housing configured to be at least partially inserted into an ear canal of a user, a vent that provides venting between an inner region of the ear canal and the ambient environment, an acoustic valve with a valve member configured to adjust the effective size of the vent, an actuator that actuates the valve member, and an acoustic output transducer acoustically coupled to the inner region of the ear canal and configured to generate a sound output according to an audio signal. The hearing device further includes a control unit operatively connected to the actuator and the acoustic output transducer and configured to control the audio signal supplied to the acoustic output transducer such that the sound output is modified during adjustment of the valve member.

15 Claims, 2 Drawing Sheets

HEARING DEVICE COMPRISING A VENT WITH AN ADJUSTABLE ACOUSTIC VALVE

The disclosure relates to a hearing device comprising a housing to be at least partially inserted into an ear channel of a user and comprising an active vent. An active vent comprises an adjustable acoustic valve with a valve member which is actuated by an actuator for adjusting an effective size of the vent.

A vent is a channel extending through the hearing device for connecting an inner region of the ear channel and the ambient environment, so as to allow for pressure equalization between those regions when the hearing device is worn in the ear channel. The adjustable acoustic valve of an active vent allows to adjust a size of the vent such that the amount of pressure equalization can be changed by the acoustic valve. To this end, the acoustic valve comprises a valve member actuated/driven by an actuator so as to increase or reduce the size of the vent; for example, the actuator may comprise an electromagnetic element, and the valve member may be rotatable or axially movable relative to the hearing device housing.

EP 2 202 996 A2 relates to an earphone device having a vent with an acoustic valve which is to be adjusted manually.

EP 2 835 987 B1 relates to a hearing aid with an active vent having an acoustic valve which is automatically adjustable so as to change the acoustical impedance of the vent by using an electrical actuator, wherein the acoustic valve may be automatically opened or closed depending on the ambient sound.

During adjustment of a movable valve member vibrations may be generated by impact of the moving valve member on stationary mechanical elements, such as the housing. Such vibrations may result in sound which may be perceived by the person wearing the hearing device. For example, such sound may be disturbing when interfering with desired sound generated by the electroacoustic output transducer of the hearing device.

U.S. Pat. No. 6,823,176 B2 relates to methods of masking of artefacts in mobile phone systems.

It is an object of the disclosure to provide for a hearing device with an active adjustable vent which allows for convenient use even during adjustment/actuation of the acoustic valve of the vent.

The hearing device comprises a control unit operatively connected to the actuator and the acoustic transducer and configured to control the audio signal supplied to the acoustic transducer such that the sound output of the acoustic output transducer is modified during actuation/adjustment of the valve member compared to the sound output during times with no actuation/adjustment of the valve member in a manner so as to reduce or eliminate perception of the sound resulting from actuation/adjustment of the valve member by the user. Thereby unpleasant sensations of the user during actuation/adjustment of the acoustic valve can be avoided or at least substantially reduced. In particular, interference of noise resulting from valve actuation/adjustment with the desired sound generated by the acoustic transducer can be avoided or reduced.

Hereinafter, "actuation of the valve member" and "adjustment of the valve member" are used as synonyms.

In some implementations, the control unit may be configured to adjust, during adjustment of the valve member, the level of the audio signal by adjusting a gain applied to the audio signal supplied to the acoustic output transducer. In particular, the gain applied to the audio signal may be increased during adjustment of the valve member. For example, the control unit may be configured to increase, during adjustment of the valve member, based on an psychoacoustic model and taking into account the spectral characteristics of the sound resulting from adjustment of the valve member, the gain applied to the audio signal in a frequency selective manner such that the sound output of the acoustic transducer is suitable to mask the sound resulting from adjustment of the valve member.

According to some implementations, the control unit may be configured to gradually increase the gain during an initial attack interval and to gradually decrease the gain during a final release interval, wherein the initial attack interval may immediately precede the adjustment of the valve member. In some implementations, the attack time constant applied in the initial attack interval may be shorter than the release time constant applied in the final release interval. Such gradual increase and decrease of the gain, in particular a relatively slow decrease of the gain during the release interval, is beneficial for avoiding unpleasant user sensations caused by abrupt gain changes; the start of the adjustment of the valve member may be delayed by the duration of the attack interval.

In some implementations, the audio signal to be supplied to the acoustic output transducer is captured from ambient sound by a microphone arrangement of the hearing device; alternative or in addition the audio signal may be received from an external audio source, such as a streaming device or communication device, via a wired or wireless link. Thus, the actually desired sound can be used to mask the potentially disturbing sound caused by adjustment of the valve member.

In some implementations, the control unit may be configured to adjust, during adjustment of the valve member, the composition of the audio signal by adding a valve adjustment audio signal to the audio signal prior to supplying the audio signal to the acoustic output transducer. Also in this case, the audio signal to which the valve adjustment audio signal is added may be captured from ambient sound by a microphone arrangement of the hearing device or may be received from an external audio source.

In some implementations, the control unit may be configured to generate the valve adjustment audio signal, by selecting level and spectral composition of the valve adjustment audio signal based on a psychoacoustic model and taking into account the spectral characteristics of the sound reciting from adjustment of the valve member, in a manner so that the sound output of the transducer is suitable to mask the sound resulting from adjustment of the valve member.

Thus, as an alternative or in addition to adjusting the gain of the audio signal supplied to the acoustic transducer, an additional audio signal, namely the valve adjustment audio signal, may be supplied to the acoustic transducer, which additional audio signal is designed to mask the potentially disturbing sound reciting from adjustment of the valve member. Such implementations are particularly beneficial in case that the audio signal (which may be, for example, a microphone signal or a streaming signal from an external audio source), without an additional audio signal being added, is not suitable for masking the sound resulting from adjustment of the valve member, for example in case that the level of the audio signal is too low or even zero (this may happen, for example, in case that the audio signal is provided by the microphone arrangements during times when no sufficient ambient sound is present) or in case that the audio signal is a signal received from an external audio source during times when the streamed audio signal contains silences.

In some implementations the control unit may be configured to generate the valve adjustment audio signal, by selecting level and spectral composition of the valve adjustment audio signal based on a psychoacoustic model and taking into account the spectral characteristics of the sound resulting from adjustment of the valve member, in a manner so that the sound output of the acoustic output transducer resulting from a valve adjustment audio signal is suitable for being perceived by the user. In particular, the valve adjustment audio signal may be generated in a manner so that it encodes information for the user concerning the adjustment of the valve member. For example, the valve adjustment audio signal may be perceivably different dependent on whether the adjustment of the valve member increases the effective size of the vent or reduces the effective size of the vent. In some implementations, such difference could be achieved by selecting a different dominant frequency (or frequency range) of the audio signal; for example, a higher frequency may be selected in cases in which the effective size of the vent is increased, and a lower frequency may be selected when the effective size of the vent is decreased, or vice versa.

Thereby, the valve adjustment audio signal may be used not only for masking potentially disturbing sound resulting from adjustment of the valve member but in addition may provide useful information concerning the valve adjustment to the user.

In some implementations, the acoustic valve may be moveably coupled with the housing such that the effective size of the vent can be adjusted by adjustment of the valve member relative to the housing.

In some implementations, the valve member may be axially moveable relative to the housing by translational motion, or the valve member may be rotatable relative to the housing.

In some implementations, the actuator may be an electromagnetic actuator.

BRIEF DESCRIPTION OF THE DRAWINGS

Examples of the disclosure are illustrated by reference to the drawings, wherein.

Figure 1:
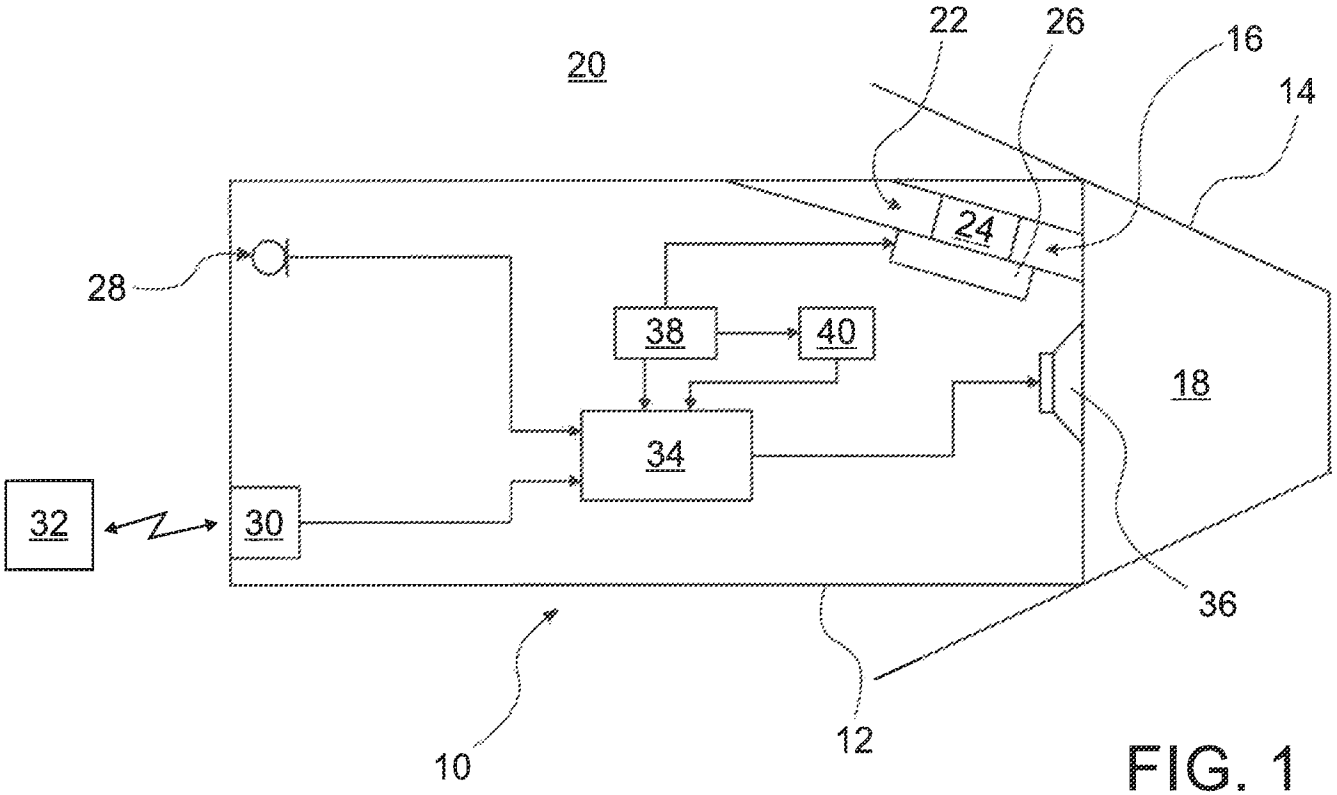
FIG. 1 is a schematic illustration of an example of a hearing device.

The drawings have not necessarily been drawn to scale. Similarly, some components and/or operations may be separated into different blocks or combined into a single block for the purposes of discussion of some of the embodiments of the disclosure. Moreover, while the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

As used hereinafter, "hearing devices" include all kind of audio devices which are to be inserted at least in part into the ear canal and which include an acoustic output transducer for supplying sound into the ear canal. Such devices include, for example, earbuds, earphones, in-ear headphones, and all kinds of hearing aids.

As used hereinafter, "effective size of the vent" relates to the degree of the venting function presently provided by the vent as a result of the present position of valve member.

FIG. 1 is a schematic illustration of an example of a hearing device 10 comprising a housing 12 to be at least partially inserted into an ear channel 14 of a user, the housing 12 comprising a vent 16 which provides for venting of sound waves between an inner region 18 of the ear channel 14 and ambient environment 20 outside the ear channel 14 through the vent 16. The vent 16 comprises an acoustic valve 22 which includes a valve member 24 and an actuator 26. The valve member 24 is movably coupled with the housing 12 such that an effective size of the vent 16 can be adjusted by adjustment of the valve member 24 relative to the housing 12, wherein the actuator 26 is configured to adjust the valve member 24 relative to the housing 12.

The hearing device 10 also comprises an audio source, which may be a microphone arrangement 28 for capturing an audio signal from ambient sound and/or an audio input 30 which may receive an audio signal from an external device 32, such as a streaming device or a communication device, via a wired or a wireless link.

The audio signal from the microphone arrangement 28 and/or the audio input 30 is supplied as input to a signal processing unit 34 for processing the audio signal, so as to provide a processed audio signal (as referred to as "output audio signal" hereinafter) which is supplied to an electroacoustic output transducer 36, such as a loudspeaker. The output transducer 36 is acoustically coupled to the inner region 18 of the ear channel 14 when the hearing device 10 is worn in the ear channel and generates a sound output according to the output audio signal supplied to the output transducer 36.

The hearing device 10 further comprises a control unit 38 which is operatively connected to the actuator 26 and the output transducer 36 via the signal processing unit 34. The control unit 38 is configured to control the audio signal supplied to the acoustic output transducer 36 in such a manner that the sound output provided by the output transducer 36 based on the output audio signal is modified during adjustment of the valve member 24 compared to the sound output of the transducer 36 during times with no adjustment of the valve member, with the sound output accordingly being modified such that perception of sound resulting from adjustment of the valve member 24 by the user is reduced or eliminated. In some implementations, the audio signal as processed in the signal processing unit 34 is controlled in such a manner that the output audio signal supplied to the output transducer 36 is suitable for masking any disturbing sound resulting from adjustment of the valve member 24.

In some implementations, the control unit 38 may be configured to adjust the level of the audio signal during adjustment of the valve member 24 by adjusting a gain applied to the audio signal in the audio signal processing unit 34. In particular, the gain applied to the audio signal may be increased during adjustment of the valve member 24.

In some implementations, the control unit 38 may use a psychoacoustic model and may also take into account spectral characteristics of the sound resulting from adjustment of the valve member 24 when increasing the gain during adjustment of the valve member 24; in this case, the gain will be applied to the audio signal in the signal processing unit 34 in a frequency selective manner so that the resulting sound output of the output transducer 36 is suitable to mask the sound resulting from adjustment of the valve member 24. The spectral characteristics of the sound resulting from adjustment of the valve member 24 may be determined empirically. The psychoacoustic model may be a standard model or it may be user specific.

In some implementations, the gain may be gradually increased during an initial attack interval and gradually decreased during a final release interval. The initial attack interval may immediately precede the adjustment of the valve member, so that adjustment of the valve member 24 begins immediately after the initial attack interval, i.e. when the gain already has been increased to the desired value suitable for masking the sound resulting from adjustment of the valve member 24. The attack time constant applied in the initial attack interval may be shorter than the release time constant applied in the final release interval. Such gradual adjustment of the gain helps to avoid unpleasant sensations for the user due to abrupt gain changes.

In some implementations the control unit 38 may be configured to modify, during adjustment of the valve member 24, the composition of the output audio signal supplied to the output transducer 36 by adding a specific valve adjustment audio signal to the audio signal input supplied to the signal processing unit 34 from the microphone arrangement 28 and/or the audio input 30. To this end, the control unit 38 may be operatively connected to an audio signal generator 40 for generating the valve adjustment audio signal.

In some implementations, the valve adjustment audio signal may be generated by selecting level in spectral composition of the valve adjustment audio signal based on a psychoacoustic model and taking into account the spectral characteristics of the sound resulting from adjustment of the valve member 24 in a manner so that the sound output of the output transducer 36 is suitable to mask the sound resulting from adjustment of the valve member 24.

In some implementations, the valve adjustment audio signal may be generated by selecting level and spectral composition of the valve adjustment audio signal based on a psychoacoustic model and taking into account the spectral characteristics of the sound reciting from adjustment of the valve member 24 in a manner so that the sound output of the output transducer 36 resulting from the valve adjustment audio signal is suitable for being perceived by the user.

In particular, the valve adjustment audio signal may be generated in a manner so that it encodes information for the user concerning the adjustment of the valve member 24. For example, the valve adjustment audio signal may be generated in a manner so that it is perceivably different depending on whether the adjustment of the valve member 24 increases the effective size of the vent 16 or reduces the effective size of the vent 16, for example by using different main frequencies.

Figure 2:
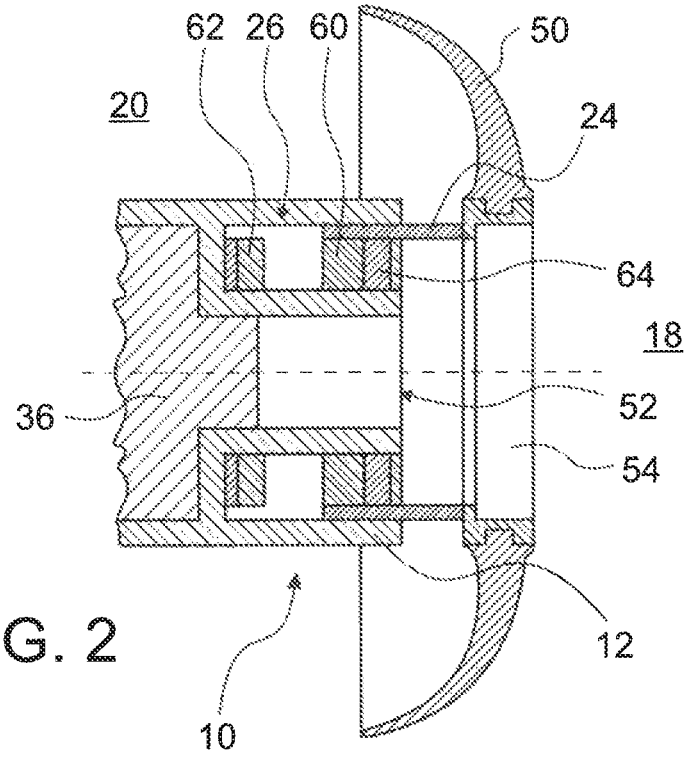
FIG. 2 is a cross-sectional view of an example of an adjustable acoustic valve to be used in the hearing device of FIG. 1, wherein the valve is shown in a closed position.
Figure 3:
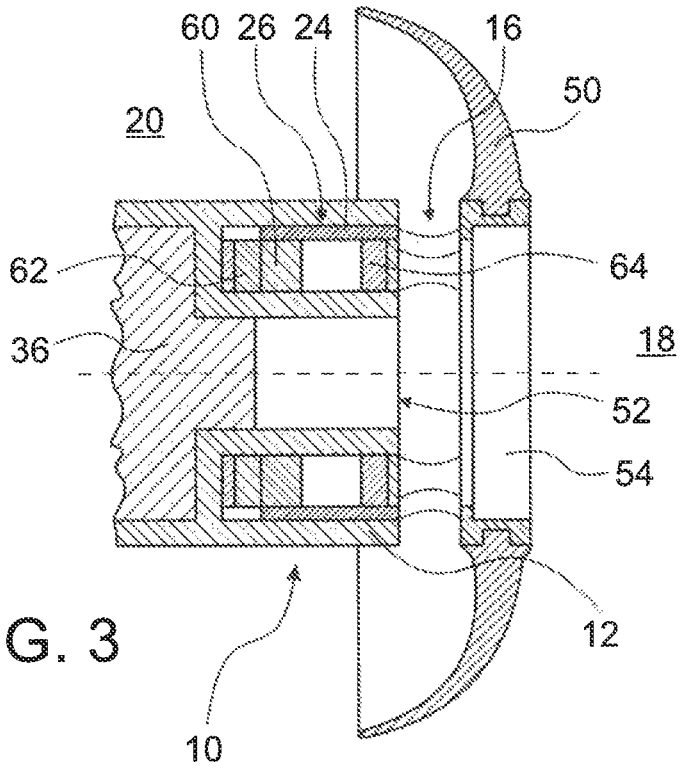
FIG. 3 is a view like FIG. 2, wherein, however, the valve is shown in an open position.

A cross-sectional view of an example of an adjustable acoustic valve 22 which may be used in the hearing device illustrated in FIG. 1 is shown in FIG. 2 (closed position of the vent) and FIG. 3 (open position of the vent). In this example, the hearing device 10 is shown with a flexible seal 50 for engaging with the user's ear canal 14 so as to seal the inner region 18 of the ear canal from ambient 20. The housing 12 includes a sound conduit 52 at the end facing the ear canal, which extends through an opening of the flexible seal 50 so as to form a sound outlet 54 for sound generated by the acoustic output transducer 36. The sound conduit 52 is provided with a vent 16 formed by lateral openings provided in the wall of the sound conduit 52.

In the closed position shown in FIG. 2 these opening are covered by a cylindrical valve element 24 of an adjustable acoustic valve 22. The valve element 24 is axially moveable relative to the sound conduit 52 by an electromagnetic actuator 26 comprising magnetic members 60, 62, and 64. The magnetic members 62 and 64 may be electromagnets for selectively generating a magnetic field in the space between them when a corresponding current is applied. The magnetic member 60 may be a permanent magnet which is fixed to the valve member and which is located in the space between the magnetic members 62 and 64 for axially moving the valve member 24 in response to the magnetic field generated by the magnetic members 62 and 64.

In the open position shown in FIG. 3 these opening of the vent 16 are open as the result of an axial movement of the valve element 24 due to corresponding actuation of the magnetic members 62 and 64 which act on the permanent magnetic member 60.

Detailed examples of hearing devices having an adjustable vent with an acoustic valve are described in the International Patent Application PCT/EP2018/069105.

The techniques introduced here can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to program a computer (or other electronic devices) to perform a process. The machine-readable medium may include, but is not limited to, optical disks, compact disc read-only memories (CD-ROMs), magneto-optical disks, read-only memories (ROMs), random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is non-transitory computer readable medium, where in non-transitory medium excludes a propagating signal.

The phrases "in some implementations," "according to some implementations," "in the implementations shown," "in other implementations," and generally mean the particular feature, structure, or characteristic following the phrase is included in at least one implementation of the disclosure, and may be included in more than one implementation. In addition, such phrases do not necessarily refer to the same embodiments or different implementations.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize.

For example, while processes or blocks are presented in a given order, alternative implementations may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

What is claimed is:

1. A hearing device comprising a housing (12) configured to be at least partially inserted into an ear canal (14) of a user and comprising a vent (16), wherein the vent is configured to provide for venting between an inner region (18) of the ear canal and an ambient environment (20) outside the ear canal through the vent, an acoustic valve (22) comprising a valve member (24) configured to adjust an effective size of the vent and an actuator (26) configured to actuate the valve member for adjustment of the effective size of the vent, an acoustic output transducer (36) acoustically coupled to the inner region of the ear canal and configured to generate a sound output according to an audio signal supplied to the acoustic transducer, characterized by a control unit (38) operatively connected to the actuator and the acoustic output transducer and configured to control the audio signal supplied to the acoustic output transducer such that the sound output is modified during adjustment of the valve member compared to the sound output during times with no adjustment of the valve member in a manner so as to reduce or eliminate the user's perception of sound resulting from adjustment of the valve member.

2. The hearing device of claim 1, wherein the control unit (38) is configured to adjust, during adjustment of the valve member (24), the level of the audio signal supplied to the acoustic output transducer (36) by adjusting a gain applied to the audio signal.

3. The hearing device of claim 2, wherein the control unit (38) is configured to increase, during adjustment of the valve member (24), the gain applied to the audio signal supplied to the acoustic output transducer (36).

4. The hearing device of claim 3, wherein the control unit (38) is configured to increase, during adjustment of the valve member (24), based on a psychoacoustic model and taking account spectral characteristics of the sound resulting from adjustment of the valve member, the gain applied the audio signal supplied to the acoustic output transducer (36) in a frequency selective manner such that the sound output of the acoustic output transducer is suitable to mask the sound resulting from adjustment of the valve member.

5. The hearing device of claim 3, wherein the control unit (38) is configured to gradually increase the gain during an initial attack interval and to gradually decrease the gain during a final release interval.

6. The hearing device of claim 5, wherein the initial attack interval immediately precedes the adjustment of the valve member (24).

7. The hearing device of claim 5, wherein the attack time constant applied in the initial attack interval is shorter than the release time constant applied in the final release interval.

8. The hearing device of claim 1, further comprising a microphone arrangement (28) for capturing the audio signal supplied to the acoustic output transducer (36) from ambient sound and/or an audio signal input (30) for receiving the audio signal form an external sound source.

9. The hearing device of claim 8, wherein the control unit (38) is configured to change a gain model applied to the audio signal supplied to the acoustic output transducer (36) according to the position of the valve member (24) resulting from the adjustment of the valve member.

10. The hearing device of claim 1, wherein the control unit (38) is configured to adjust the composition of the audio signal by adding, during adjustment of the valve member (24), a valve adjustment audio signal to the audio signal supplied to the acoustic output transducer (36).

11. The hearing device of claim 10, wherein the control unit (38) is configured to generate the valve adjustment audio signal, by selecting level and spectral composition of the valve adjustment audio signal based on a psychoacoustic model and taking account the spectral characteristics of the sound resulting from adjustment of the valve member (24), in a manner so that the sound output of the acoustic output transducer (36) is suitable to mask the sound resulting from adjustment of the valve member.

12. The hearing device of claim 10, wherein the control unit (38) is configured to generate the valve adjustment audio signal, by selecting level and spectral composition of the valve adjustment audio signal based on a psychoacoustic model and taking account the spectral characteristics of the sound resulting from adjustment of the valve member (24), in a manner so that the sound output of the acoustic output transducer (26) resulting from the valve adjustment audio signal is suitable for being perceived by the user.

13. The hearing device of claim 12, wherein the control unit (38) is configured to generate the valve adjustment audio signal in a manner so that it encodes information for the user concerning the adjustment of the valve member (24).

14. The hearing device of claim 13, wherein the control unit (38) is configured to generate the valve adjustment audio signal in a manner so that it so that it is perceiveably different depending on whether the adjustment of the valve member (24) increases the effective size of the vent (16) or reduces the effective size of the vent.

15. A method of operating the hearing device (10) of claim 1, comprising;

inserting the housing (12) at least partially into the ear canal (14) of a user;

supplying an audio signal to the acoustic output transducer (36) and generating, by the acoustic output transducer (36), a sound output according to audio signal;

adjusting the valve member relative to the housing by the actuator (26); and modifying, by control unit (38) during adjustment the valve member, the audio signal supplied to the acoustic output transducer such that the sound output is modified during adjustment of the valve member compared to the sound output during times with no adjustment of the valve member in a manner so as to reduce or eliminate the user's perception of sound resulting from adjustment of the valve member.

* * * * *